US009349502B2

(12) United States Patent
Kizaki

(10) Patent No.: US 9,349,502 B2
(45) Date of Patent: May 24, 2016

(54) AUTOMOTIVE WIRE

(71) Applicant: FUJIKURA LTD., Koto-ku, Tokyo (JP)

(72) Inventor: Takeshi Kizaki, Chiba (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 13/720,164

(22) Filed: Dec. 19, 2012

(65) Prior Publication Data

US 2013/0105197 A1 May 2, 2013

Related U.S. Application Data

(63) Continuation of application No. PCT/JP2011/064299, filed on Jun. 22, 2011.

(30) Foreign Application Priority Data

Jun. 24, 2010 (JP) ..... 2010-143717

(51) Int. Cl.
*H01B 7/00* (2006.01)

(52) U.S. Cl.
CPC ..... *H01B 7/0009* (2013.01)

(58) Field of Classification Search
CPC ..... H01B 7/009
USPC ..... 174/102 R, 108, 109, 126.1, 126.2
See application file for complete search history.

(56) References Cited

U.S. PATENT DOCUMENTS

| | | | | | |
|---|---|---|---|---|---|
| 3,966,425 | A * | 6/1976 | Takeo | B21F 19/00 | 428/680 |
| 6,204,452 | B1 | 3/2001 | Valadez et al. | | |
| 7,228,627 | B1 * | 6/2007 | Yoshimura | H01B 5/104 | 174/108 |
| 2008/0277138 | A1 * | 11/2008 | Gallens | D07B 1/148 | 174/111 |
| 2010/0139947 | A1 * | 6/2010 | Kojima | C09J 9/02 | 174/126.1 |

FOREIGN PATENT DOCUMENTS

| | | | | |
|---|---|---|---|---|
| CN | 2605647 | Y | | 3/2004 |
| CN | 2798256 | Y | | 7/2006 |
| CN | 1913046 | A | | 2/2007 |
| CN | 101221834 | A | * | 7/2008 |
| JP | 04-080394 | A | | 3/1992 |
| JP | 04080394 | A | * | 3/1992 |
| JP | 04-237531 | A | | 8/1992 |
| JP | 11-329084 | A | | 11/1999 |
| JP | 2004-207079 | A | | 7/2004 |
| JP | 2007-023305 | A | | 2/2007 |
| JP | 4041970 | B2 | | 2/2008 |
| JP | 4279203 | B2 | | 6/2009 |

OTHER PUBLICATIONS

Chinese Office Action issued Mar. 12, 2014 in Chinese Patent Application No. 201180018600.5.

Tongxuan, Z., "Improvement of Pre-coating Technology for Cu-cladded Steel Wire", Metal Products, vol. 25 No. 2.

Chinese Office Action issued Apr. 27, 2015 in Chinese Patent Application No. 201180018600.5.

* cited by examiner

*Primary Examiner* — Timothy Thompson
*Assistant Examiner* — Paul McGee, III
(74) *Attorney, Agent, or Firm* — Sughrue Mion, PLLC

(57) ABSTRACT

The present invention is an automotive wire provided with a conductor including at least one solid wire composed of a core and a metal film that covers the surface of the core, and an insulator that covers the conductor, wherein the core is composed of carbon steel, and the metal film has a thickness of 12.4 μm to 29.6 μm.

6 Claims, 7 Drawing Sheets

AUTOMOTIVE WIRE

CROSS REFERENCE TO RELATED APPLICATIONS

This application is a Continuation of National Stage of International Application No. PCT/JP2011/064299 filed Jun. 22, 2011, claiming priority based on Japanese Patent Application No. 2010-143717 filed Jun. 24, 2010, the contents of all of which are incorporated herein by reference in their entirety.

TECHNICAL FIELD

The present invention relates to an automotive wire used in, for example, wire harnesses.

BACKGROUND ART

The use of electronics is becoming increasingly prevalent in the field of automobiles in recent years, and the wiring used to connect various types of electronic devices installed in vehicles is increasing in both quantity and complexity. Although automotive wires referred to as wire harnesses are used to connect these electronic devices, accompanying the growing prevalence of electronics in vehicles as mentioned above, these wire harnesses are becoming increasingly large.

On the other hand, together with the growing worldwide interest in environmental issues, automobiles are also being required to reduce emission levels of carbon dioxide as well as be lighter in order to improve fuel consumption.

In vehicles such as hybrid vehicles and electric cars in which the use of electronics has increased, there are cases in which wire harnesses can weigh more than about 30 kg. Accordingly, in order to reduce vehicle weight, it is considered to be effective to reduce the weight of wire harnesses, and particularly the weight of automotive wire that accounts for a large proportion of the weight of those wire harnesses.

One method that has been considered for reducing the weight of automotive wire consists of the use of materials having a lower specific gravity for the materials serving as lead wires used in automotive wires.

Examples of methods for using materials having a low specific gravity include a method that uses aluminum for the lead conductors composing automotive wires, and a method that uses Cu-coated Al wires in which a core composed of aluminum is coated with copper (see, for example, Patent Document 1 and Patent Document 2). In addition, automotive wire is also known that uses a Cu alloy and the like for the lead conductor (see, for example, Patent Document 3).

However, there are also cases in which automotive wire is required to be lightweight while at the same time having high strength, such as breaking strength in excess of 1000 MPa.

In the case of using a lightweight material as described above, for example, aluminum wires were unable to be used as automotive wire due to the low strength and in terms of contact resistance with terminals. In addition, Cu-coated Al wire and Cu alloy were also unable to be used in consideration of strength. Moreover, when the cross-sectional area of the lead wire is increased in order to secure strength, this leads to increased weight and size of the wire harness. Consequently, it is necessary to achieve both a narrow diameter and high strength while realizing reduced weight for use as automotive wire.

An example of a method for realizing an automotive wire having both a narrow diameter and high strength consists of using wire obtained by plating Cu onto high-strength stainless steel wire (see, for example, Patent Document 4). This automotive wire secures strength by employing stainless steel wire as a tension member, and is formed by forming Cu as an electrically conductive layer around the stainless steel wire using plating method. As a result of employing this configuration for an automotive wire, both light weight and high strength required by recent automotive wires are realized.

PRIOR ART DOCUMENTS

Patent Documents

Patent Document 1: Japanese Patent Publication No. 4279203

Patent Document 2: Japanese Patent Application Publication No. 2004-207079

Patent Document 3: Japanese Patent Application Publication No. 2007-23305

Patent Document 4: Japanese Patent Publication No. 4041970

SUMMARY OF THE INVENTION

Problems to Be Solved By the Invention

However, in the confined spaces within automobiles, automotive wire is wired in a bent state, and is frequently wrapped around components within the automobile.

However, when the automotive wire described in the above-mentioned Patent Document 4 was wrapped around a component, cracks could occur in the Cu plating layer of the automotive wire. These cracks can cause strength deterioration and rusting of the automotive wire.

In addition, automotive wire is also required to have high electrical conductivity and superior corrosion resistance.

With the foregoing in view, an object of the present invention is to provide an automotive wire that has high breaking strength and electrical conductivity while realizing a narrow diameter, has superior corrosion resistance, and is resistant to bending.

Means for Solving the Problems

The present invention provides the following means for achieving the above-mentioned object.

The automotive wire according to the present invention is provided with a conductor including at least one solid wire composed of a core and a metal film that covers the surface of the core, and an insulator that covers the conductor, wherein the core is composed of carbon steel, and the metal film has a thickness of 12.4 μm to 29.6 μm.

According to this automotive wire, since a wire material formed from a core and a metal film that covers the surface of the core is used as a conductor of an automotive wire, and carbon steel is used for the core, an automotive wire can be provided that has high breaking strength and electrical conductivity while realizing a narrow diameter, has superior corrosion resistance, and is resistant to bending.

In the above-mentioned automotive wire, the conductor may be a twisted wire obtained by twisting together a plurality of the solid wires.

In the above-mentioned automotive wire, the metal film is made of preferably copper, aluminum or an alloy containing copper and/or aluminum. In this case, electrical conductivity can be increased.

In the above-mentioned automotive wire, a nickel plating layer is preferably further provided between the core and the metal film.

In this case, since a nickel plating layer is present between the core and the metal film, the metal material that composes the metal film can be prevented from diffusing in the core composed of carbon steel, thereby making it possible to improve the degree of adhesion between the core and the metal film.

Here, the nickel plating layer preferably has a thickness of 0.1 μm to 0.5 μm.

If the thickness of the nickel plating layer is within the above-mentioned range, adhesive strength between the nickel plating layer and the core is further improved in comparison with the case of the thickness being less than 0.1 μm. In addition, if the thickness of the nickel plating layer is within the above-mentioned range, since the amount of expensive Ni used is reduced in comparison with the thickness exceeding 0.5 μm, the price of the automotive wire can be further reduced.

In the above-mentioned automotive wire, the carbon content of the carbon steel is preferably 0.1% by mass to 1.0% by mass.

In addition, the present invention relates to the use of the above-mentioned automotive wire in an automobile.

Effects of the Invention

According to the present invention, since a wire material formed from a core and a metal film that covers the surface of the core is used as a conductor of an automotive wire, and carbon steel is employed for the core, an automotive wire can be provided that has high breaking strength and electrical conductivity while realizing a narrow diameter, has superior corrosion resistance, and is resistant to bending.

MODES FOR CARRYING OUT THE INVENTION

First Embodiment

Figure 1:
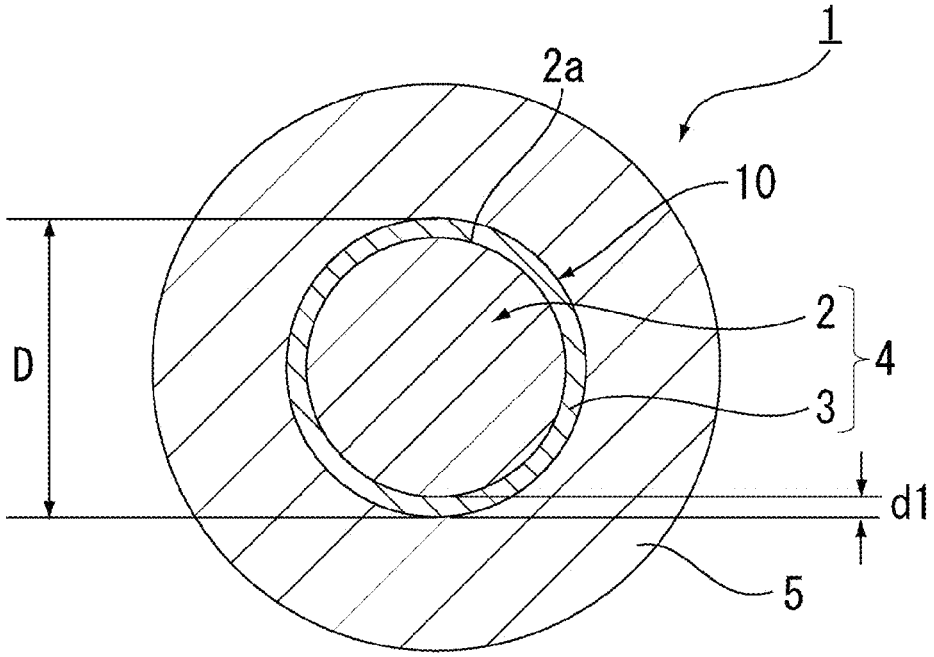
FIG. 1 is a schematic cross-sectional view of an automotive wire according to a first embodiment of the present invention.

The following provides a detailed explanation of a first embodiment of the present invention with reference to the drawings. FIG. 1 is a schematic cross-sectional view showing an automotive wire according to the first embodiment of the present invention.

As shown in FIG. 1, an automotive wire 1 of the present invention is composed of a conductor 10 composed of a solid wire 4 for conducting electricity, and an insulator 5 for protecting the conductor 10 and insulating from the outside. The solid wire 4 is composed of a core 2 and a metal layer 3 that covers a surface 2*a* of the core 2. In the automotive wire 1 of the present invention, the core 2 is composed of carbon steel.

Although there are no particular limitations thereon, the carbon content in the carbon steel is preferably 0.1% by mass to 1.0% by mass, and more preferably 0.69% by mass to 0.76% by mass. Hard steel wire materials (steel wire rods—high carbon (SWRH)), for example, are used as carbon steel having a carbon content of 0.1% by mass to 1.0% by mass, and SWRH72, for example, is used as carbon steel having a carbon content of 0.69% to 0.76%. As a result of using such carbon steel, automotive wire can be realized that has higher breaking strength than conventional stainless steel wire.

The metal film 3 is formed so as to cover the surface 2*a* of the core 2. Although copper (Cu) is preferable for the metal material that composes the metal film 3, the metal material that composes the metal film 3 is not limited to copper provided the metal film 3 has a film thickness capable of achieving the required level of electrical conductivity. Metal materials allowing the obtaining of adequate electrical conductivity, such as aluminum (Al), chromium (Cr), gold (Au) or silver (Ag), can be suitably employed in addition to copper for the metal material that composes the metal film 3. The above-mentioned metal material is preferably copper, aluminum or an alloy containing copper and/or aluminum. In this case, electrical conductivity can be further increased.

Copper-nickel (Cu—Ni) alloy is an example of an alloy that contains copper and/or aluminum. The use of an alloy as described above for the metal film 3 makes it possible to improve abrasion resistance, corrosion resistance and the like of the automotive wire 1.

A thickness (plating thickness) d1 of the metal film 3 is 12.4 μm to 29.6 μm in order to achieve required electrical conductivity, corrosion resistance and bending strength. If the thickness d1 of the metal film 3 is less than 12.4 μm, electrical conductivity decreases, resistance to bending decreases and corrosion resistance becomes inferior. On the other hand, if the thickness d1 of the metal film 3 exceeds 29.6 μm, the strength of the automotive wire 1 decreases, increases in Cu area ratio are small even if plating thickness is increased, surface properties become poor, cracks form easily when the automotive wire 1 is bent, or tensile strength decreases.

Furthermore, in the case of using Ag or Au for the metal film 3, since Ag and Au have lower electrical conductivity than Cu, it is necessary to secure the required electrical conductivity by forming a thicker plating layer than in the case of using Cu.

A diameter D of the solid wire 4 is preferably 0.109 mm to 0.143 mm. If the diameter D of the solid wire 4 is within the above-mentioned range, electrical conductivity increases and resistance to bending becomes greater in comparison with the case of being outside the above-mentioned range. Here, the diameter D of the solid wire 4 refers to the diameter of the solid wire 4.

The insulator 5 is formed from a resin having insulating properties, flame resistance, oil resistance, water resistance and the like, such as polypropylene-based resin, polyethylene-based resin, polyvinyl chloride resin, fluorine-based resin (such as PTFE, PFA, FEP or ETFE) or foamed bodies thereof.

Next, an explanation is provided of a production method of the automotive wire 1.

First, the core 2 is prepared. The core 2 can be obtained by using the above-mentioned carbon steel and wire drawing to a final wire diameter. More specifically, patenting treatment is carried out on a high-carbon, hard steel wire material (SWRH72). Patenting treatment is a treatment consisting of, for example, rapidly cooling from an austenitic range of about 1000° C. to 500° C. to 600° C. and holding for a prescribed amount of time at that temperature, followed by cooling to room temperature. The core 2 having a narrow diameter is obtained as a result of this patenting treatment.

In this manner, the strength of the core 2 composed of carbon steel is increased as a result of narrowing diameter.

Although there are no particular limitations thereon, the wire diameter of the core 2 may be, for example, 0.05 mm to 0.2 mm.

Next, an explanation is provided of a method for forming the metal film 3 (to also be subsequently referred to as a "plating layer" or simply as "plating") on the core 2.

The metal film 3 is formed using a pyrophosphoric acid plating bath containing a metal material that composes the metal film 3. In the following, the formation steps thereof are explained in order.

(1) Degreasing

First, electrolytic degreasing is carried out on the core 2 by, for example, immersing the core 2 in a 10% by mass NaOH solution. Furthermore, degreasing is not limited to electrolytic degreasing provided mainly oily contaminants present on the surface 2*a* of the core 2 can be cleaned off, and degreasing can also be carried out using other known degreasing methods such as ultrasonic degreasing.

(2) Acid Activation

Next, acid activation is carried out on the surface 2*a* of the core 2 by, for example, immersing the degreased core 2 for 15 seconds in 10% by mass HCl.

(3) Strike Plating

Next, strike plating is carried out. Strike plating is a method for carrying out surface cleaning and activation with hydrogen gas generated in a liquid. In the present embodiment, pyrophosphoric acid, for example, is used for the plating solution. In striking plating, although current density and treatment time vary according to the thickness of strike plating, in the case the current density is 1 A/dm$^2$, for example, the plating treatment time is, for example, 60 seconds.

(4) Final Plating

Next, final plating treatment for imparting adequate current density is carried out on the upper surface of the strike plating layer. Final plating treatment employs pyrophosphoric acid solution for the plating solution. In final plating treatment, current density and final plating treatment time may be, for example, as indicated below in order to make the thickness of the metal film 3 to be formed 12.4 μm to 29.6 μm. Namely, in the case of a current density of 3 A/dm$^2$, for example, the final plating treatment time is 5 minutes to 60 minutes. Since the thickness of the metal film 3 formed by final plating treatment depends on the above-mentioned final plating treatment time, final plating treatment time may be suitably modified as necessary.

Furthermore, in the case of forming the metal film 3 composed of copper in the present embodiment, Pyrodon Conc. Containing copper (manufactured by Murata Co., Ltd.), for example, can be used for the pyrophosphoric acid solution. Since substances that are harmful to the environment or people are not contained in the components of the pyrophosphoric acid solution, effects on the environment and people can be reduced during plating treatment.

The conductor 10 composed of the solid wire 4 can be obtained by drying the core 2 on which the metal film 3 has been formed following final plating treatment.

Next, the solid wire 4 obtained in the manner described above is coated with the insulator 5. The insulator 5 is formed to a uniform thickness by extrusion molding, for example, so as to cover the solid wire 4.

Production of the automotive wire 1 is completed in this manner.

According to the above-mentioned production method of the automotive wire 1, carbon steel is used for the core 2. Consequently, unlike in the case of using stainless steel for the core 2, there is hardly any formation of a rigid passive oxide film on the surface 2*a* of the core 2. Consequently, the possibility of an oxide film remaining can be eliminated and Cu plating can be carried out easily. Namely, according to the above-mentioned production method of the automotive wire 1, a passive oxide film does not remain on a portion of the surface 2*a* of the core 2, and plating of that portion can be adequately prevented from becoming adequate. As a result, in addition to the metal film 3 being able to be formed easily, corrosion of the core 2 and separation of the metal film 3 from the surface 2*a* of the core 2 do not occur. In addition, a pyrophosphoric acid solution is used when coating the metal film 3 on the core 2 that composes the automotive wire 1, and the pyrophosphoric acid solution does not contain substances that are harmful to the environment or people. Namely, plating of carbon steel does not require the use of highly dangerous chemicals such as hydrochloric acid. Consequently, effects on people and the environment can be reduced. Moreover, the thickness of the metal film 3 is made to be sufficiently large when producing the automotive wire 1. Consequently, the automotive wire 1 can be produced to have high breaking strength and electrical conductivity, superior corrosion resistance and high bending strength without the occurrence of pinholes.

Second Embodiment

Figure 2:
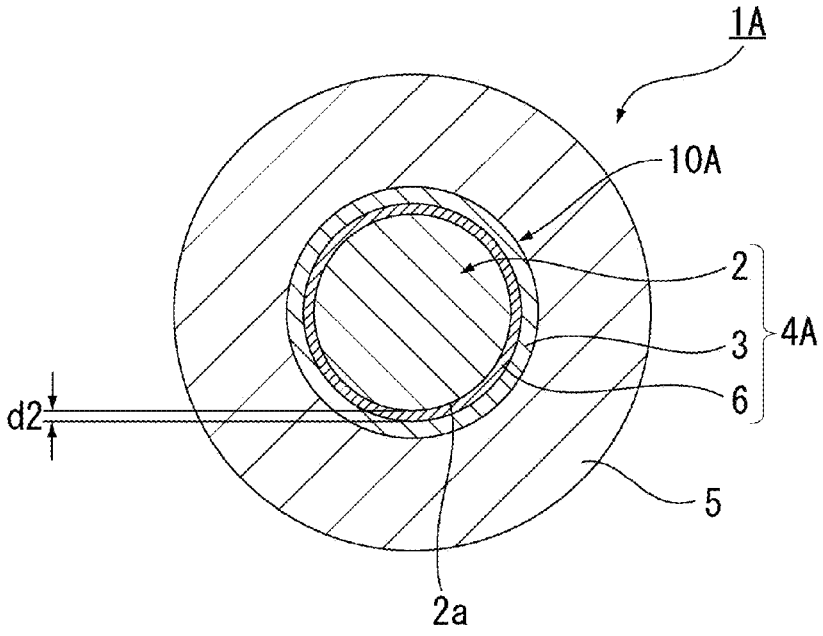
FIG. 2 is a schematic cross-sectional view of an automotive wire according to a second embodiment of the present invention.

Next, a detailed explanation is provided of an automotive wire according to a second embodiment of the present invention. Furthermore, constituent elements of the second embodiment that are the same or similar to those of the first embodiment are indicated with the same reference symbols, and duplicate explanations thereof are omitted. FIG. 2 is a schematic cross-sectional view of an automotive wire 1A according to the second embodiment.

As shown in FIG. 2, the automotive wire 1A according to the second embodiment of the present invention differs from the automotive wire 1 of the first embodiment in that a nickel (Ni) plating layer 6 is further provided between the core 2 composed of carbon steel and the metal film 3 composed of Cu plating. Namely, as shown in FIG. 2, a conductor 10A is composed of a solid wire 9A, and the solid wire 4A is composed of the core 2, the metal film 3, and the Ni plating layer 6 provided between the core 2 and the metal film 3.

In this case, since the automotive wire 1A additionally has the Ni plating layer 6 between the core 2 and the metal film 3, the metal material that composes the metal film 3 can be prevented from diffusing into the core 2 composed of carbon steel, thereby making it possible to improve the degree of adhesion between the core 2 and the metal film 3.

Here, a thickness d2 of the Ni plating layer 6 is preferably 0.1 μm to 0.5 μm and more preferably 0.2 μm to 0.4 μm. If the thickness of the Ni plating layer 6 is within the above-mentioned ranges, adhesive strength between the Ni plating layer 6 and the core 2 is further improved as compared with the case of being less than 0.1 μm. In addition, if the thickness of the Ni plating layer 6 is within the above-mentioned ranges, since the amount of expensive Ni used can be reduced in comparison with exceeding 0.5 μm, the price of the automotive wire 1A can be further reduced, while also offering the advantage of being able to shorten plating time when forming the Ni plating layer 6. Furthermore, the Ni plating layer 6 may also contain other metals within a range that does not impair adhesive strength.

Here, an explanation is provided of a method for forming the Ni plating layer 6 on the core 2.

(1) Degreasing

First, degreasing is carried out on the core 2 by anodic electrolytic treatment by immersing the core 2 in, for example, a 10% by mass NaOH solution.

(2) Acid Activation

Next, acid activation is carried out on the surface 2*a* of the core 2 by, for example, immersing the degreased core 2 for 15 seconds in 10% by mass HCl.

(3) Ni Plating

Next, Ni plating is carried out on the core 2 in a Watts bath following surface activation. In this Ni plating treatment, although current density and Ni plating treatment time vary according to the thickness d2 of the Ni plating layer 6 to be formed, in order to make the thickness d2 of the Ni plating layer 6 to be 0.1 μm to 0.5 μm, for example, the Ni plating treatment time may be 30 seconds to 120 seconds in the case the current density is, for example, 2 A/dm$^2$. Furthermore, since the thickness d2 of the Ni plating layer 6 depends on the Ni plating treatment time, the thickness d2 can be suitably adjusted by adjusting the Ni plating treatment time.

Furthermore, after having formed the Ni plating layer 6, final plating treatment is carried out on the upper surface of the Ni plating layer 6 to impart adequate current density in the same manner as in the first embodiment. However, final plating treatment is preferably carried out with a copper sulfate plating bath.

Following final plating treatment, the solid wire 4A of the present embodiment can be obtained by drying the core 2 on which the metal film 3 has been formed.

As described above, a commonly used Watts bath is used to form the Ni plating layer 6 on the core 2 composed of carbon steel. In the case of Ni, since Ni is not electrolytically deposited on the core 2 composed of carbon steel, the Ni plating layer 6 can be obtained that demonstrates favorable adhesion to the core 2 by thinly plating Ni on the core 2.

In this manner, Cu can be prevented from diffusing into the core 2 composed of carbon steel by providing the Ni plating layer 6 between the core 2 composed of carbon steel and the metal film 3 composed of Cu plating.

In addition, in the case of carrying out Cu plating on the Ni plating layer 6 with a copper sulfate plating bath, problems such as defective adhesion between Ni and Cu do not occur, and by carrying out Cu plating on the Ni plating layer 6, the degree of adhesion between the core 2 and the Cu plating layer (metal film 3) can be improved.

Figure 7:
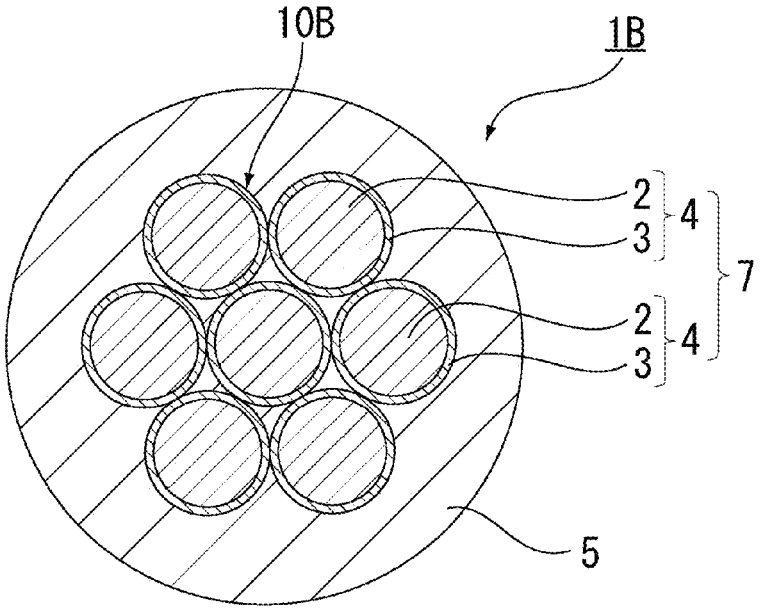
FIG. 7 is a schematic cross-sectional view of an automotive wire according to another embodiment of the present invention.

Furthermore, the present invention is not limited to the previously described first and second embodiments. For example, although the case of the automotive wire 1 or 1A having a single solid wire 4 or 4A was explained in the above-mentioned first and second embodiments, the present invention is not limited thereto. For example, as shown in FIG. 7, a twisted wire 7 obtained by twisting together a plurality of the solid wires 4 may also be used as a conductor. FIG. 7 is a schematic cross-sectional view showing an embodiment of an automotive wire 1B provided with a plurality of the solid wires 4 and in which the solid wires 4 are twisted together to obtain the twisted wire 7. In FIG. 7, a conductor 10B is composed of the twisted wire 7.

The wire diameter of the solid wires 4 that compose the twisted wire 7 may be smaller than that of the solid wire 4 or 4A of the automotive wire 1 or 1A that uses only a single solid wire 4 or 4A, and the total cross-sectional area resulting from twisting together a plurality of such solid wires 4 or 4A may be equal to or greater than the single solid wire 4 or 4A in the automotive wire 1 or 1A.

In addition, each of the constituent elements of the above-mentioned first and second embodiments can be modified in various ways within a range that does not deviate from the gist of the present invention.

EXAMPLES

Although the following provides a more specific explanation of the contents of the present invention by listing examples thereof while comparing with comparative examples that are outside the scope of the present invention, the present invention is not limited to the following examples.

Examples 1 to 4 and Comparative Examples 1 to 3

First, patenting treatment was carried out on a hard steel wire material (SWRH72) having a diameter of 1.0 mm. The carbon content in this hard steel wire material was 0.7% by mass. In addition, patenting treatment consisted of rapidly cooling from an austenitic range of about 1000° C. to 550° C. and holding for 0.5 hours at that temperature, followed by cooling to room temperature. Subsequently, wire drawing was carried out to obtain a core having a wire diameter of 0.084 mm. The metal composition in the core consisted of a pearlite structure throughout the entire core. In addition, measurement of final breaking strength of the core yielded a breaking strength of 3700 MPa.

Continuing, electrolytic degreasing was carried out on the core by immersing the core in a 10% by mass NaOH solution.

Next, the surface of the core was subjected to acid activation by immersing the degreased core for 15 seconds in 10% by mass HCl.

Next, strike plating was carried out on the core following acid activation of the surface thereof. Strike plating was carried out for a treatment time of 60 seconds using a pyrophosphoric acid solution having a current density of 1 A/dm$^2$ for the plating solution.

Next, final plating treatment was carried out on the upper surface of the strike plating layer obtained by the above-mentioned strike plating. Pyrodon Conc. (manufactured by Murata Co., Ltd.) was used for the plating solution in final plating treatment. In addition, the current density was 3 A/dm$^2$ and final plating treatment time was as shown in Table 1. Solid wires were fabricated in this manner.

Next, the solid wires were coated with an insulator composed of polyvinyl chloride resin. Automotive wires were obtained in this manner.

Examples 5 to 8

Figure 3:
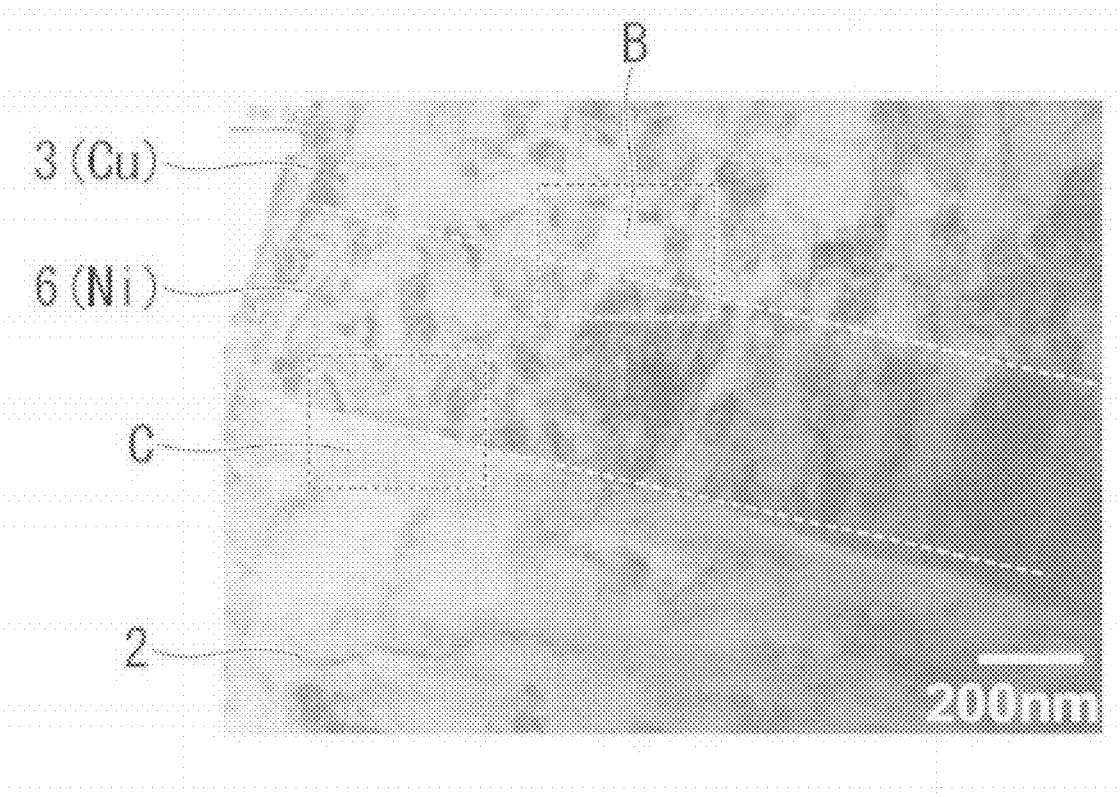
FIG. 3 is a micrograph depicting the interface between a copper plating layer and carbon steel of an automotive wire of Example 5 as observed with a transmission electron microscope.
Figure 4:
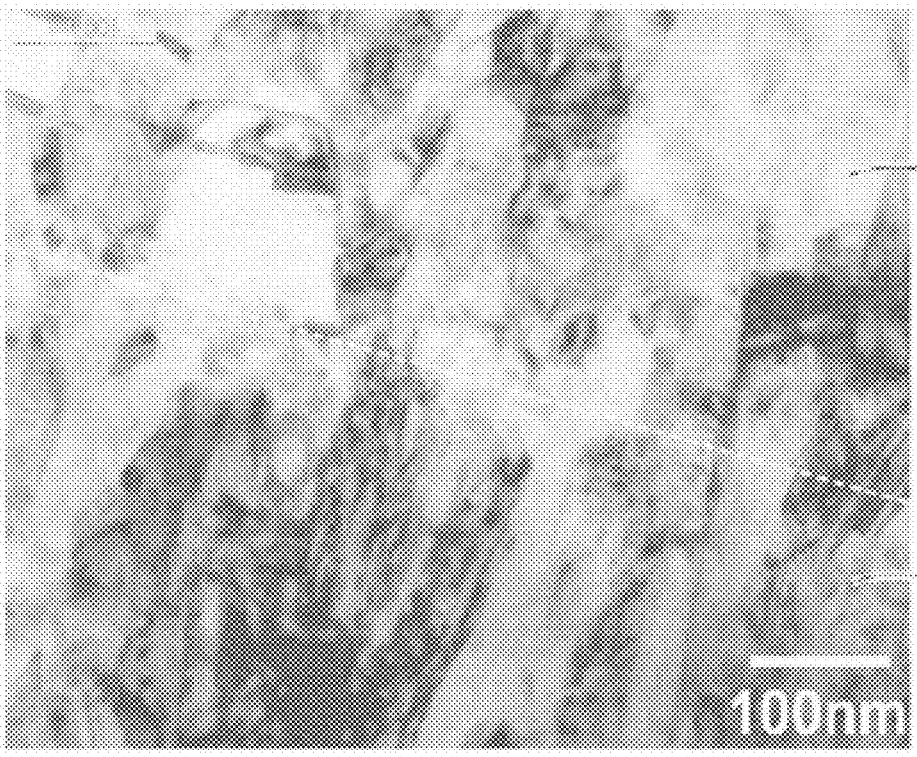
FIG. 4 is a partially enlarged view showing the enclosed area indicated by B in FIG. 3.
Figure 5:
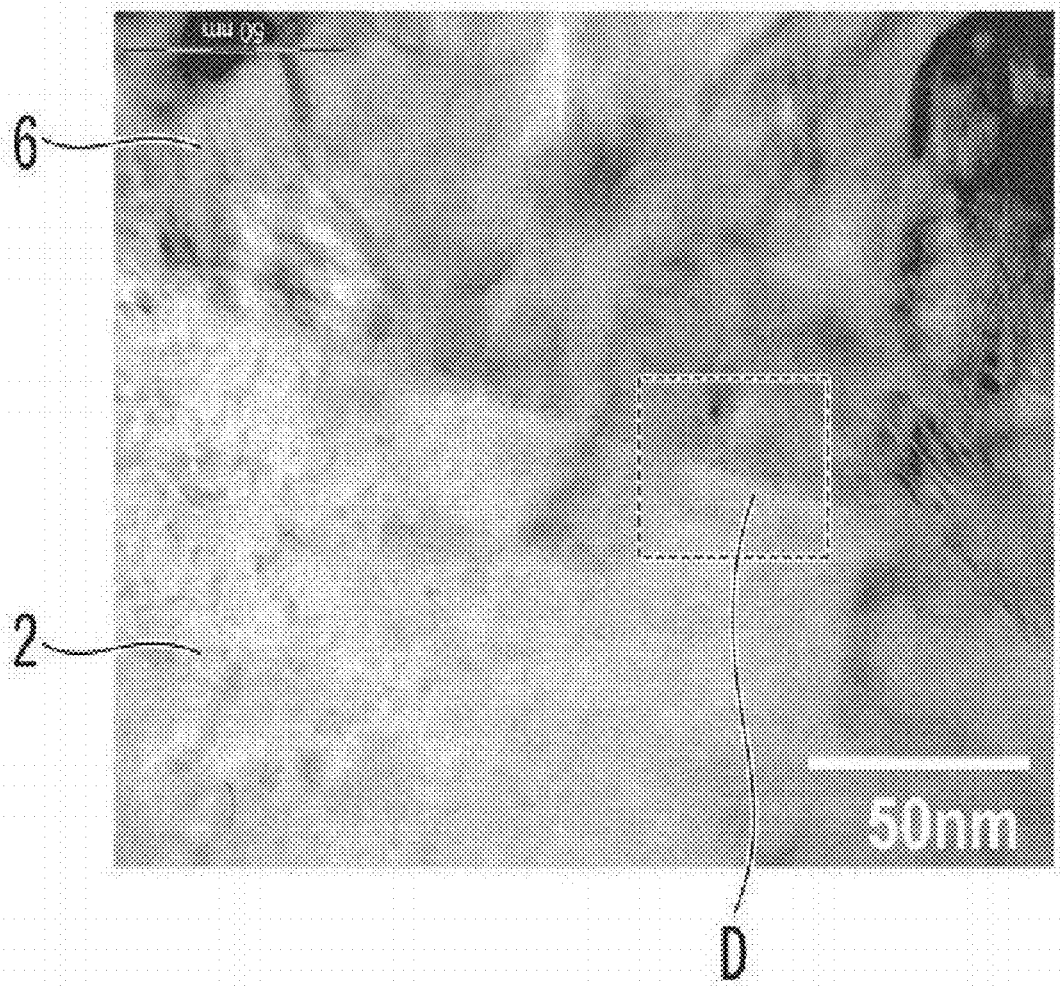
FIG. 5 is a partially enlarged view showing the enclosed area indicated by C in FIG. 3.
Figure 6:
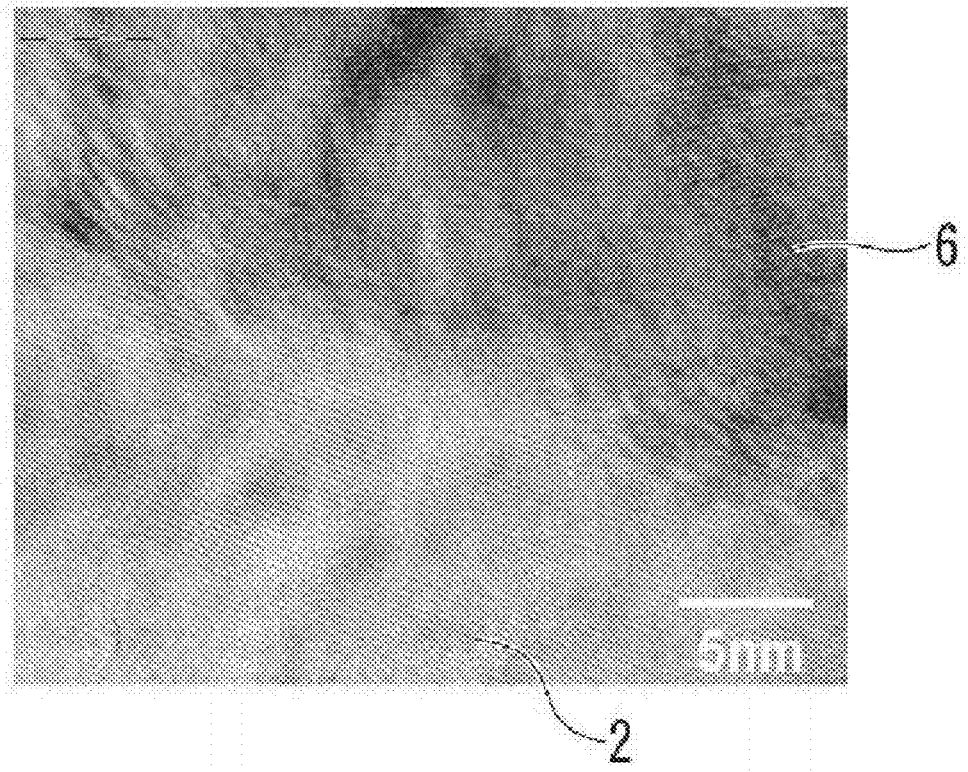
FIG. 6 is a partially enlarged view showing the enclosed area indicated by D in FIG. 5.

First, automotive wires were fabricated in the same manner as Example 1 with the exception of carrying out Ni plating on the core following acid activation of the surface thereof with a Watts bath in which current density was set to 2 A/dm$^2$ and the Ni plating times were set as shown in Table 1 instead of carrying out strike plating on the core following acid activation of the surface thereof, using a copper sulfate plating bath for the plating bath of the final plating treatment, setting a current density to 10 A/dm$^2$ and setting the final plating treatment times as shown in Table 1. Furthermore, the interface between the Cu plating layer and carbon steel was observed for the solid wire of the automotive wire obtained in Example 5 using a transmission electron microscope (TEM). The results are shown in FIGS. 3 to 6. FIG. 3 is a micrograph depicting the state of the interface between the Cu plating layer (metal film 3) and carbon steel (core 2) which was observed with a transmission electron microscope (TEM). FIG. 4 is a partially enlarged view showing the enclosed area indicated by B in FIG. 3, and FIG. 5 is a partially enlarged view showing the enclosed area indicated by C in FIG. 3. In addition, FIG. 6 is a partially enlarged view showing the enclosed area indicated by D in FIG. 5.

As is clear from FIG. 4, the interface between Ni and Cu formed between the metal film 3 composed of Cu plating and the core 2 composed of carbon steel was determined to be completely connected. In addition, as is clear from FIGS. 5 and 6, the interface between Ni and carbon steel was also determined to be completely connected. Furthermore, the interface between Ni and Cu formed between the metal film 3 composed of Cu plating and the core 2 composed of carbon steel as well as the interface between Ni and carbon steel were also completely connected in the solid wires of the automotive wires obtained in Examples 6 to 8 in the same manner as in Example 5.

The automotive wires and solid wires obtained in Examples 1 to 8 and Comparative Examples 1 to 3 were evaluated using the methods described below.

(1) Wire Diameter and Cu Area Ratio

Diameter D of the solid wires of the automotive wires obtained in Examples 1 to 8 and Comparative Examples 1 to 3 was measured with a micrometer. The results are shown in Table 1. Furthermore, in Table 1, "average wire diameter" refers to the average value of wire diameter measured three times with a micrometer for each solid wire, and this average wire diameter is the same as solid wire diameter D.

In addition, solid wire cross-sectional area and Cu cross-sectional area were calculated on the basis of average wire diameter and Cu plating thickness, and Cu area ratio was calculated based on the equation indicated below.

$$\text{Cu area ratio (\%)} = 100 \times [\text{Cu plating cross-sectional area/solid wire cross-sectional area}]$$

(2) Breaking Strength

Stress generated when the solid wires broke was measured using a tensile tester for the automotive wires obtained in Examples 1 to 8 and Comparative Examples 1 to 3. Breaking strength (MPa) was then calculated from this stress and solid wire cross-sectional area. The results are shown in Table 1. Furthermore, the acceptance criterion for breaking strength was set at "1300 MPa or more" in consideration of current requirements specifications for automotive wires.

(3) Electrical Conductivity

Electrical conductivity of the solid wires of the automotive wires obtained in Examples 1 to 8 and Comparative Examples 1 to 3 was measured using a conductivity meter. The results are shown in Table 1. Furthermore, the acceptance criterion for electrical conductivity was set at "40% IACS or more" in consideration of current requirements specifications for automotive wires. Here, electrical conductivity (% IACS) represents a relative ratio based on a value of 100 for electrical conductivity equivalent to the electrical resistance value of the International Annealed Copper Standard.

(4) Wrapping Test

A wrapping test was carried out by wrapping the automotive wires obtained in Examples 1 to 8 and Comparative Examples 1 to 3 around a rod having a diameter of 0.3 mm. Subsequently, the surfaces of the solid wires were observed with a transmission electron microscope (TEM) to confirm the presence or absence of cracks in the surface. The results are shown in Table 1. In Table 1, automotive wires in which cracks were not confirmed in the surface of the solid wire were indicated with an "A", and those in which cracks were confirmed in the surface of the solid wire were indicated with a "B". Here, automotive wires indicated with an "A" were evaluated as being acceptable, while those indicated with a "B" were evaluated as being unacceptable.

(5) Saltwater Spray Test

A saltwater spray test was carried out by placing one meter lengths of the automotive wires obtained in Examples 1 to 8 and Comparative Examples 1 to 3 in a saltwater spray apparatus. The automotive wires were removed after one month followed by confirming the appearance for the absence of a discolored portion. The results are shown in Table 1. In Table 1, automotive wires that were not confirmed to have a discolored portion in the appearance were indicated with an "A", while those confirmed to have a discolored portion in the appearance were indicated with a "B". Here, automotive wires indicated with an "A" were evaluated as being acceptable, while those indicated with a "B" were evaluated as being unacceptable.

TABLE 1

| | Final plating time (min) | Average wire diameter (mm) | Metal film (Cu plating) thickness (μm) | Cu area ratio (%) | Ni plating time (sec) | Ni plating layer thickness (μm) | Breaking strength (MPa) | Electrical conductivity (% IACS) | Wrapping test | Saltwater spray test |
|---|---|---|---|---|---|---|---|---|---|---|
| Comp. Ex. 1 | 5 | 0.092 | 3.8 | 16 | — | — | 2840 | 17.5 | B | B |
| Comp. Ex. 2 | 10 | 0.095 | 5.7 | 23 | — | — | 3033 | 23.7 | B | B |
| Example 1 | 20 | 0.109 | 12.4 | 40 | — | — | 2293 | 41.2 | A | A |
| Example 2 | 30 | 0.117 | 16.3 | 48 | — | — | 2176 | 46.3 | A | A |
| Example 3 | 40 | 0.123 | 19.6 | 54 | — | — | 2034 | 51.1 | A | A |
| Example 4 | 60 | 0.143 | 29.6 | 66 | — | — | 1484 | 57.1 | A | A |
| Example 5 | 20 | 0.109 | 12.4 | 40 | 30 | 0.12 | 2295 | 41.1 | A | A |
| Example 6 | 20 | 0.109 | 12.4 | 40 | 60 | 0.25 | 2298 | 41.0 | A | A |
| Example 7 | 20 | 0.109 | 12.4 | 40 | 90 | 0.375 | 2301 | 40.8 | A | A |
| Example 8 | 20 | 0.109 | 12.4 | 40 | 120 | 0.5 | 2305 | 40.6 | A | A |
| Comp. Ex. 3 | 80 | 0.163 | 36.0 | 69 | — | — | 1290 | 60.2 | B | A |

According to the results shown in Table 1, the automotive wires of Comparative Examples 1 and 2 having small values for Cu plating thickness satisfied the criterion for breaking strength. However, since electrical conductivity was 40% IACS or less, it was found that the automotive wires of Comparative Examples 1 and 2 did not satisfy the acceptance criterion for electrical conductivity. In addition, the automotive wire of Comparative Example 3 having a large value for Cu plating thickness satisfied the criterion for electrical conductivity. However, since breaking strength was less than 1300 MPa, it was found that the automotive wire of Comparative Example 3 did not satisfy the acceptance criterion for breaking strength.

In addition, cracks formed in Comparative Examples 1 and 2 in the wrapping test. In the case of thin Cu plating, the interface between the Cu plating and steel wire (core) (Cu plating/steel wire) is present on the outer periphery where bending stress becomes large. As a result, the Cu plating separates and cracks are presumed to form in the Cu plating due to considerable stress acting on the Cu plating/steel wire interface. In addition, cracks also formed in Comparative Example 3 in the wrapping test. In the case Cu plating is excessively thick, irregularities in the Cu plating surface become large, and this causes the formation of cracks. Cracks are presumed to have formed in the Cu plating as a result thereof.

Moreover, corrosion occurred in Comparative Examples 1 and 2 in the saltwater spray test. On the basis thereof, it was presumed that pinholes were present in a portion of the Cu plating in the automotive wires of Comparative Examples 1 and 2.

In contrast, all of the automotive wires of Examples 1 to 8 having a large value for the thickness of the Cu plating achieved electrical conductivity of 40% IACS or more. More specifically, electrical conductivity of 40% was achieved by making the thickness of the Cu plating to be 12.4 μm or more. Moreover, the automotive wires of Examples 1 to 8 also achieved breaking strength of 1300 MPa or more.

In addition, the automotive wires of Examples 1 to 8 were free of cracks in the Cu plating as a result of carrying out the wrapping test. As the thickness of the Cu plating increases, the Cu plating/steel wire interface is present on the inside of the wire material where bending stress is low. As a result, it was presumed that, since the load at the Cu plating/steel wire interface is reduced, the Cu plating does not separate from the steel wire (core), and that the formation of cracks in the Cu plating has been able to be prevented.

Moreover, a corroded portion according to the saltwater spray test was not confirmed in the automotive wires of Examples 1 to 8. Pinholes were thought to have been completely eliminated due to the thick Cu plating.

In addition, according to the results for Examples 1 to 8, if the automotive wire further has an Ni plating layer between the Cu plating and the core, it was found that the Cu plating did not separate from the steel wire (core) even if the wrapping test was repeated ten times.

On the basis of the above, according to the automotive wire of the present invention, the automotive wire was confirmed to have high breaking strength and electrical conductivity, have superior corrosion resistance, and be resistant to bending as a result of carrying out thick Cu plating on a core composed of carbon steel.

EXPLANATION OF THE REFERENCE NUMERALS

1,1A,1B Automotive wire
2 Core
2*a* Core surface
3 Metal film
4,4A Solid wire
5 Insulator
6 Ni plating layer
7 Twisted wire
10,10A,10B Conductor
D Solid wire diameter
d1 Metal film thickness
d2 Ni plating layer thickness

The invention claimed is:

1. An automotive wire, comprising:
a conductor including at least one solid wire composed of a core and a metal film that covers a surface of the core; and
an insulator that covers the conductor,
a nickel plating layer between the core and the metal film,
wherein the core is composed of carbon steel,
the metal film has a thickness of 12.4 μm to 19.6 μm,
the nickel plating layer has a thickness of 0.2 μm to 0.4 μm and
the metal film covers the entire nickel plating layer so that the inner peripheral surface of the metal film is in contact with the entire outer peripheral surface of the nickel plating layer.

2. The automotive wire according to claim 1, wherein the conductor is a twisted wire obtained by twisting together a plurality of the solid wires.

3. The automotive wire according to claim 1, wherein the metal film is made of copper, aluminum or an alloy containing copper and/or aluminum.

4. The automotive wire according to claim 1, wherein the carbon content in the carbon steel is 0.1% by mass to 1.0% by mass.

5. The automotive wire according to claim 1, wherein the metal film consists of copper, an alloy containing copper, chromium, gold or silver.

6. The automotive wire according to claim 4, wherein the carbon content in the carbon steel is 0.69% by mass to 0.76% by mass.

* * * * *